United States Patent [19]

Blecha

[11] Patent Number: 4,907,296

[45] Date of Patent: Mar. 13, 1990

[54] APACHE HELMET MOUNTING STRUCTURE FOR AVIATORS NIGHT VISION IMAGING SYSTEM (ANVIS) AND METHOD

[75] Inventor: Bill A. Blecha, Alexandria, Va.

[73] Assignee: The United States of America as represented by the Secretary of the Army, Washington, D.C.

[21] Appl. No.: 210,475

[22] Filed: Jun. 21, 1988

[51] Int. Cl.[4] ..... A42B 3/02; A42B 1/24

[52] U.S. Cl. ..... 2/6; 2/422; 2/453; 2/243 R

[58] Field of Search ..... 2/6, 10, 422, 424, 429, 2/453, 243 R; 351/158

[56] References Cited

U.S. PATENT DOCUMENTS

| | | | |
|---|---|---|---|
| 2,445,203 | 7/1948 | Bowers | 2/10 |
| 3,205,303 | 9/1965 | Bradley | 2/6 X |
| 3,556,645 | 1/1971 | Heilman | 2/10 X |
| 4,146,292 | 5/1979 | Helm et al. | 2/6 |
| 4,457,461 | 7/1984 | Docking et al. | 2/6 X |
| 4,689,834 | 9/1987 | McCarthy et al. | 2/422 |

FOREIGN PATENT DOCUMENTS

| | | | |
|---|---|---|---|
| 2168595 | 6/1986 | United Kingdom | 2/6 |

*Primary Examiner*—Wm. Carter Reynolds
*Attorney, Agent, or Firm*—Milton W. Lee; Max L. Harwell; Anthony T. Lane

[57] ABSTRACT

A helmet mounting structure for mounting aviator goggles to an Army Apache helmet. The structure is a single piece that is formed and shaped to conform to the curvature of the front portion of the Apache helmet and is held firmly thereto by specially designed screws that are loosely held by the single piece structure and are threaded into at least two mounting points on each of the left and right sides of the helmet. A breakaway mount support pad, formed in the center front of the mounting structure and extends downward therefrom, has a breakaway mount thereto. The goggles may then be connected to the breakaway mount attached for swiveling up to the stow position or down in the line of sight of the aviator.

2 Claims, 2 Drawing Sheets

APACHE HELMET MOUNTING STRUCTURE FOR AVIATORS NIGHT VISION IMAGING SYSTEM (ANVIS) AND METHOD

The invention described herein may be manufactured, used, and licensed by the U.S. Government for governmental purposes without the payment of any royalties thereon.

BACKGROUND

There have been several methods tried in the past to mount the aviators night vision imaging system (ANVIS) goggle system to various aviators helmets, other than the U.S. Army Apache helmet. The present mounting structure is specifically designed and fabricated for mounting the ANVIS goggle system to the uniquely shaped Apache helmet.

Required features for the mounting structure to be used on the uniquely designed Apache aviators helmet was the need to fit the mounting structure to the helmet without modifying the helmet or interfering with the existing avionics mounted on the helmet, such as the integrated helmet and display sight system (IHADSS) which is integrated into the Apache helmet and has external features on the helmet.

SUMMARY OF THE INVENTION

The present invention comprises a helmet mounting structure attachable to an Apache helmet and to which the ANVIS goggle system is attached. The helmet mounting structure is preferably made in a single piece having an inner concave portion that is formed and shaped to conform to the unique curvature of the center front outer portion of the Apache helmet and to the curvature of an ANVIS breakaway mount, which is attachable to the mounting structure and upon which the ANVIS goggles are connected. The structure fits around the frontal areas of the helmet and is easily attachable to existing mounting points on the helmet by a helmet attachment means, whichis preferably a screw threadable attachment means. A helmet visor assembly is attachable to the existing mounting points now on the helmet. The same type attachment means used for attaching the helmet visor assembly to the helmet may be used for attaching the helmet mounting structure to the Apache helmet, thus eliminating cost of their production. The above mentioned ANVIS breakaway mount is attachable to the front of the mounting structure by a goggle attachment means, preferably by a screw threadable attachment means which is issued as supply stock along with the visor assembly.

The single piece mounting structure may be fabricated using a variety of light weight high impact resistance materials, such as aluminum or plastic. The mounting structure has the advantage of being smaller and of lighter weight than known mounting structures, thus minimizing the overall helmet weight when mounted thereon. Alternatively, the structure may be constructed of honeycomb material which may provide a light weight assembly with increased impact resistance. This type material will improve crash safety attributes through collapse of the honeycomb material on impact to deaccelerate the helmet motion relative to the impacting object and prior to the objects contact with the helmet structure.

A power cable retention means may be attached to the helmet mounting structure, or may be integrated into the structure. The retention means is required to minimize snagging of the power cables during ingress and egress of the pilot from the cockpit and to minimize possible electrical interferences or obstruction of the operators vision.

DETAILED DESCRIPTION OF THE PREFERRED EMBODIMENT

Figure 1:
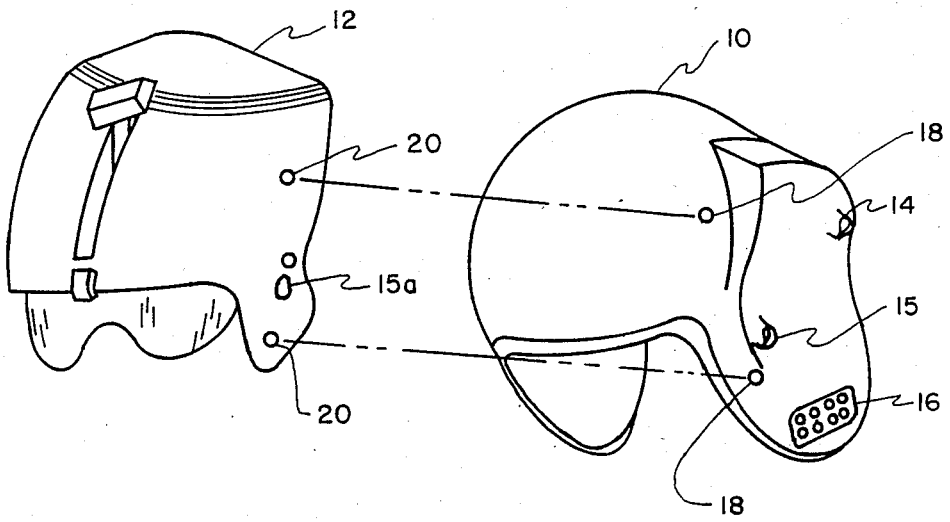
FIG. 1 PRIOR ART
FIG. 1 is a perspective view of the Apache helmet illustrating the currently used helmet visor assembly removed therefrom and juxtaposed therewith.

FIG. 1 is a perspective view of the U.S. Army Apache style aviator's helmet 10 to which an existing visor assembly 12 is attachable thereto. Assembly 12, which has a visor with a slide up and down control mechanism, is shown as removed from helmet 10 but with phantom lines ending at attachment points between 12 and 10. Normally, 12 is affixed to 10 by specially designed 6–32 screws 20 (with two screws on the opposite side of 12 not shown). It should be noted that screws 20 are issued with the helmet 10, thus a definite cost savings since these same screws are used with the present inventive helmet mounting structure as explained herein below. The screws 20 may be threadably attached to threaded visor attachment points 18 on the helmet (with two attachment points positioned on the directly opposite side of helmet 10 not shown). The attachment of screws 20 with points 18 form mounting points. There will be at least two mounting points on each of the left side and right side helmet frontal areas. These mounting points are illustrative of the helmet attachment means used with the inventive helmet mounting structure.

The Apache helmet 10 is uniquely designed to be comprised of an integrated helmet and display sight system (IHADSS) head position sensors with two sensors on each side of helmet 10, represented by numbers 14 and 15, (with two sensors positioned exactly on the opposite side of helmet 10 that cannot be shown). A quick connecy/disconnect bracket 16 is positioned on the lower left side of helmet 10 with any attachments thereto (not shown) out of the way of assembly 12 or out of the way of the helmet mounting structure 22 as will discussed with reference to FIGS. 2 and 3 below. It should be noted that when assembly 12 is attached to helmet 10 sensor 15 protrudes through opening **15*a* of visor assembly 12**.

The threaded visor attachment points 18 have 6–32 screw holes therein that mesh with the 6–32 screw threads on screws 20 for screw threadably connecting 12 to 10. Screws 20 remain with the visor assembly 12 when 12 is removed from 10.

Figure 2:
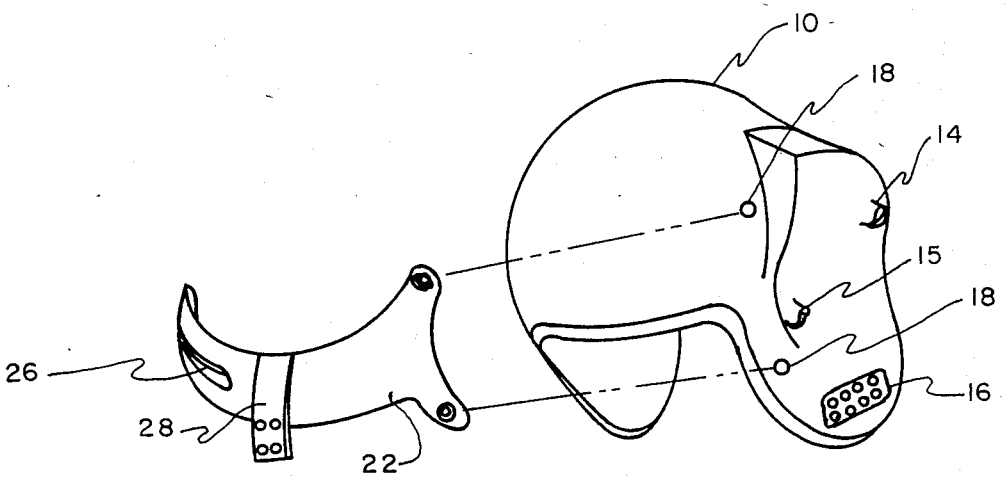
FIG. 2 is a perspective view of the same Apache helmet as shown in FIG. 1 along with the inventive helmet mounting structure with the goggles and breakaway mount shown in phantom lines as attachable thereto.
Figure 3:
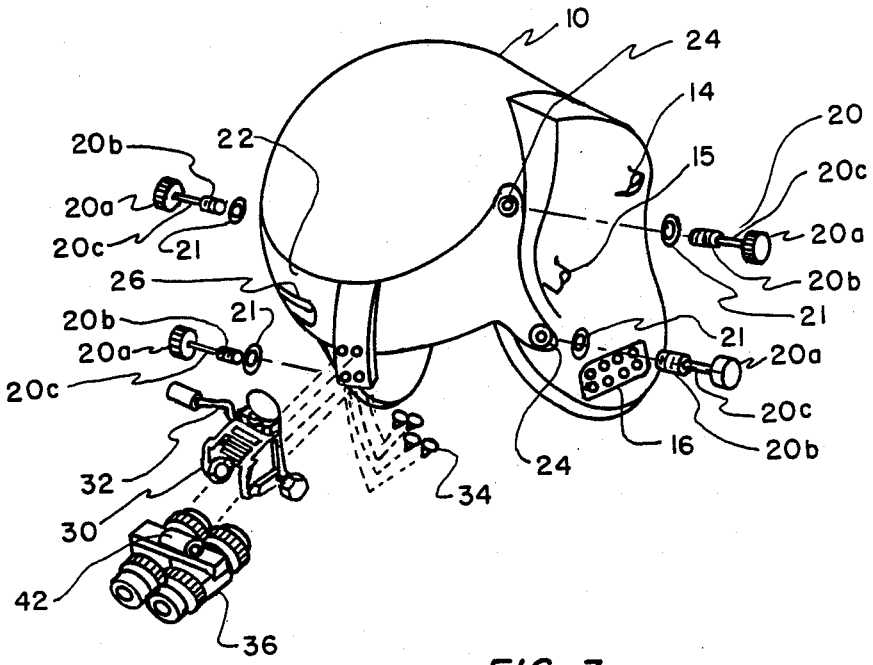
FIG. 3 is a perspective view of the inventive mounting structure as mounted to the helmet with the goggles and breakaway mount mounted to the structure.
Figure 4:
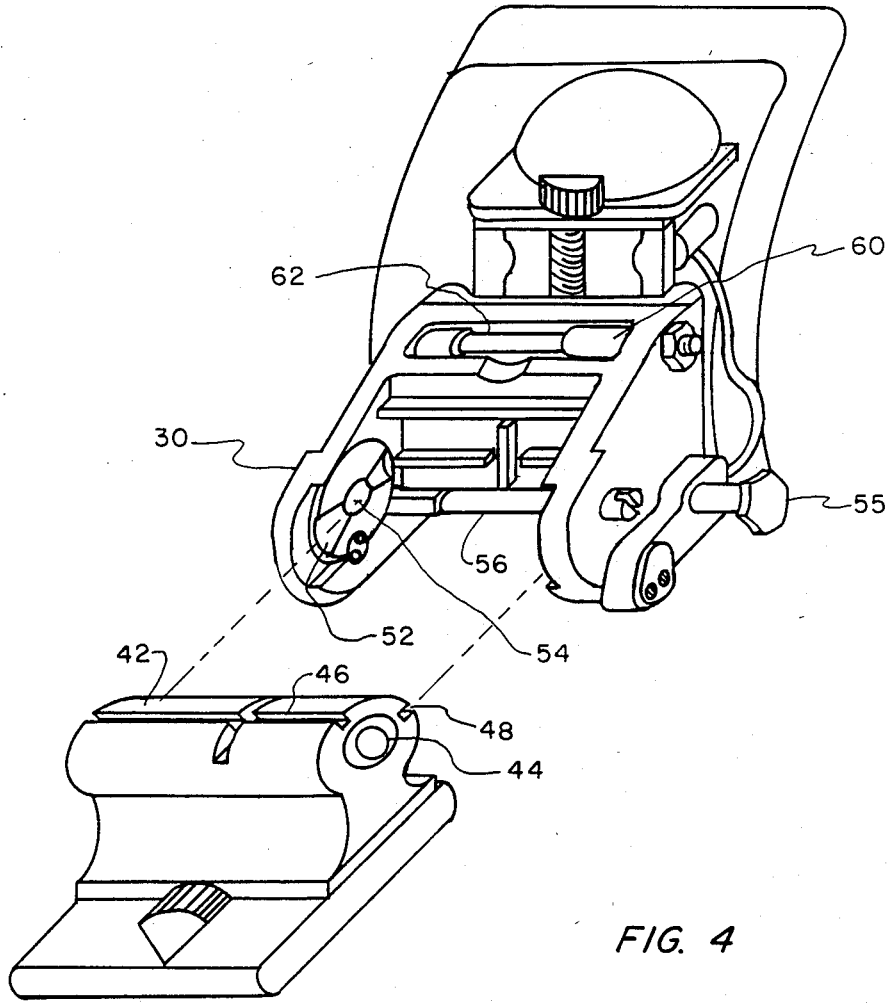
FIG. 4 is an enlarged perspective view of the goggle breakaway mount and a cylindrical portion removed from the goggle system which is attachable to the breakaway mount.

FIG. 2 illustrates a perspective view of the present inventive helmet mounting structure 22 relative to the Apache helmet 10 and is specifically shaped and form fitted to the frontal area of the helmet. Structure 22 is shaped to conform to the unique contour shell structure of helmet 10 and is preferably made in one piece. An integral part of the structure 22 is a breakaway mount support pad 28. The outer portion of pad 28 is shaped to conform to the profile of the base of an existing goggle breakaway mount 30 (FIG. 3) to which the goggles, system is in turn attached. Mount 30 may be attached to pad 28 by goggle attachment means. The goggle attachment means is preferably at least four flat headed screws 34 (FIG. 3) that are threaded through pad 28 into the breakaway mount. These screws are available in Army stock. Refer to the enlarged view of the cylindrical portion 42, shown removed from the goggle system 36, and the goggle breakaway mount 30 as shown in FIG. 4. FIG. 3 illustrates cylinder 42 as mounted on 36. Refer to FIGS. 3 and 4 simultaneously for a better illustration of how system 36 is attached to mount 30. The cylindrical portion 42 has a spring loaded ball 44 on each end with only one ball 44 shown in the perspective view. The cylinder 42 is connected to mount 30 by conveniently sliding the balls 44 along channels on each side of 30, only one channel 52 which is shown. Each of the channels 52 have a lock socket 54 into which the spring loaded balls 44 slide into and expand outward to fit snugly therein. System 36 may be thus rotated about the balls and sockets either to the overhead stow position or down in the line of sight of the aviator. Cylinder 42 has at least two grooves, shown as 46 and 48, which run along is full length and a short transverse groove in the center thereof. These grooves are used to hold goggles 36 either in the stow position or the line of sight position. Looking closely at FIG. 4 with 42 positioned in proximity to 30 as shown where if goggles 36 were attached to 42 th goggles would be in the line of sight position, the following sequence of attachment occurs. Goggles 36 are pressed along channels 52 until the balls 44 lock into sockets 54. A press to release means is used to release pressure on 42 so that the reverse sequence of moving the balls 44 from the sockets 54 and out channels 52 is accomplished. It is noted that the mount and the goggle system are not a part of the present invention but are the items being mounted on the mounting structure 22. Structure 22 has a power cable retention means 26. Means 26 may be an integral part of structure 22 or a separate attachment to the surface of 22. The means 26 may be made of VELCRO, a strap down means, a molded channel means, or other suitable means for holding a power cable (32 of FIG. 3). The mounting position of the goggle breakaway mount is such that sufficient adjustment of the goggle system can be achieved allowing proper eye position for efficient use of the goggles. That is, mount 30 may be adjusted up or down on the breakaway mount support pad 28.

Reference FIG. 3 for further explanation of the inventive helmet mounting structure 22. Consider the helmet attachment means, which is preferably comprised of screws 20 and washers 21 (optionally) which are attachable through structure 22 to the attachment points 18 on helmet 10. Screws 20 have special features which are as follows. The screws have large diameter thin knurled outer edge heads 20a, screw threaded end portions **20*b* on the end of the stem, and a smaller diameter nonthreaded central portion 20*c* of the stem. The heads 20*a* are knurled on the circumferential edges to provide easy hand gripping and turning of the stem portions of the screws. The length of the end portion 20*b* is about ⅜th inch with the overall length of the screw 20 being about ¾th inch. The screws 20 are designed to remain loosely attached through structural outward protrusions 24 on structure 22 at the smaller central portion 20*c* of the screws when the helmet mounting structure is removed from helmet 10. That is, the screws 20 will not slip off structure 22 at either the stem 20*b* or the head 20*a*. These screws come originally with the helmet 10 and have been used to attach the visor assembly 12 to the helmet 10. The washers 21 are preferably mounted on the outward protrusions 24, which protrusions are an integral part of structure 22. The washers 21 have internal screw threads which are screw threadable with screws 20. The washers 21 may be bonded or glued on the protrusions 24** and are preferably made of a light metal, such as aluminum, to prevent wear on the top portion of the protrusions over an extended period of time.

The attachment of structure 22 to the helmet 10 does not interfere with the operation of the sensors 14 and 15 (one each on each side of the helmet) or the IHADSS display sight system. This display sight system may be removed from helmet 10 when the goggle 36 is being used or the display sight system may be retained with the helmet 10 and swing out of the way when the goggle 36 is brought down in the frontal view of the aviator from the stowed positioned above the forehead. An alternate mode of operation could be the removal of system 36 from structure 22 while 22 is still affixed to helmet 10 allowing for use of the IHADSS display sight system without interference from structure 22 or breakaway mount 30.

It will be appreciated that, although the invention has been described by way of example, with reference to the accompanying drawings, variations and modifications may be made within the scope of the invention.

I claim:

1. A method for mounting an aviator night vision imaging system (ANVIS) goggle system to an aviators helmet, said method comprising the steps of:

providing a mounting structure which is shaped and form fitted to the frontal area of said helmet;

forming a power cable retention means on the front of said mounting structure to secure power cables;

forming as an integral portion of said mounting structure a breakaway mount support pad with a downward extension in the center front of said mounting structure, said support pad is shaped to conform to the curvature of a goggle breakaway mount;

attaching said goggle breakaway mount to said support pad by a goggle attachment means;

attaching said structure to said helemt by a helmet attachment means comprised of at least two mounting points on each of the left side and right side helmet frontal areas; and connecting said goggle system to said goggle breakaway mount wherein said goggle system is rotatable in the vertical direction between the aviators line of sight and in a forehead stow position.

2. An aviators helmet mounting structure for a goggle system comprising:

a single piece structure which has an inner concave portion that is formed and shaped to conform to the shape of the center front outer portion of the helmet and has a helmet attachment means comprised of two 6–32 screws on each of the left side and right side of said mounting structure which are screw threadable into two mounting points on each of the left side and right side frontal areas of said helmet, wherein each of said 6–32 screws has a large knurled head and a screw threaded end portion with screw threads for a length of about $\frac{3}{8}$th inch with a smaller diameter nonthreaded stem portion therebetween with each screw having an overall length of about $\frac{3}{4}$th inch, said single piece structure having outward protrusions at said mounting points and a breakaway mount support pad with downward extension in the center front of said mounting structure wherein said support pad is shaped to conform to the curvature of a goggle breakaway mount attachable thereto, said 6-32 screws loosely held at the outward protrusion of said mounting structure at said smaller diameter nonthreaded stem portion and retained by said screw threaded end portion and said knurled head wherein each screw is easily manually threadable and secured into said mounting points on said helmet, wherein said goggle system is connectable to said goggle breakaway mount for pivotable vertical movement between the line of sight of an aviator and a forehead stow position.

* * * * *